United States Patent [19]

Hauff

[11] Patent Number: 4,838,558

[45] Date of Patent: Jun. 13, 1989

[54] APPARATUS FOR SUPPORTING AND TENSIONING A NET

[75] Inventor: Brian L. Hauff, Vancouver, Canada

[73] Assignee: LeisureTech Sports Corp., Vancouver, Canada

[21] Appl. No.: 256,775

[22] Filed: Oct. 11, 1988

[51] Int. Cl.[4] ..... A63B 69/00

[52] U.S. Cl. ..... 273/395; 273/26 A; 273/29 A; 273/400; 273/411

[58] Field of Search ..... 273/395, 26 R, 26 A, 273/29 A, 29 BB–29 BG, 55 B, 181 F, 181 J, 181 K, 182 R, 410, 411, 127 R, 127 B, 127 C, 400

[56] References Cited

U.S. PATENT DOCUMENTS 4,489,941 12/1984 Shieh ..... 273/29 A X 4,703,931 11/1987 Steen ..... 273/26 A

*Primary Examiner*—Paul E. Shapiro

*Attorney, Agent, or Firm*—Klarquist, Sparkman, Campbell, Leigh & Whinston

[57] ABSTRACT

Apparatus for supporting and tensioning a net includes a supporting famework and a net tensioning mechanism. The tensioning mechanism includes a hub and a plurality of retainers supported by the hub, all disposed between a back wall of the net and the rear of the supporting framework. The back wall is coupled to the retainers, and a rod with a plurality longitudinally spaced pairs of radially extending legs which may be coupled to the rear of the frame at various longitudinally adjusted positions is provided to adjustably draw the hub rearwardly along a central axis thereby applying tension to side walls of the net.

8 Claims, 3 Drawing Sheets

APPARATUS FOR SUPPORTING AND TENSIONING A NET

FIELD OF THE INVENTION

This invention relates to apparatus for supporting and tensioning a net used to capture or rebound a ball or similar object.

BACKGROUND TO THE INVENTION

The prior art contains various examples of walled structures that are designed to capture or rebound a ball. An early example is shown in the U.S. Pat. No. 1,540,670 to Vidmer which discloses a netted enclsoure having a relatively large open front end, and upper, lower left and right side walls extending to a relatively small back wall. As disclosed by Vidmer, the netting is rigged to a supporting structure and to ground. He contemplates that the walls should be drawn taut, but it appears clear that the only way of achieving a desired degree of tautness or tension would be by means of several individual adjustments.

More recent examples of structures designed to capture or rebound a ball are shown in U.S. Pat. No. 4,381,110 to Balaz and U.S. Pat. No. 4,703,931 to Steen. In the case of Balaz, tensioning of upper and lower side walls and a back wall is achieved by spreading the sides of a collapsible V-shaped frame. However, to set tension in these walls, manual adjustment and setting is required at upper and lower locations, and it appears that independent adjustment of the rigging would be required in order to vary the tension in left and right side walls.

The patent to Steen similarly discloses an enclosure having a back wall and upper, lower, left and right side walls and a back wall. In this case, tensioning is achieved by a rather complex rigging arrangement which in principle is designed to pull outwardly and rearwardly from the back wall of the enclosure towards corners of a supporting framework that are fixed in position. However, the rigging is intricate and, unless properly adjusted, it is possible to have a relatively high degree of imbalance of tension between respective side walls. In such a case, the deflection when a ball strikes one of such side walls may be undesirably different from the corresponding deflection when a ball strikes another one of such side walls. Further, the rigging would become even more complex if the number of side walls was increased.

It is an object of the present invention to provide new and improved apparatus for supporting and tensioning a net.

A further object of the present invention is to provide a net tensioning means which requires a minimal number of adjustments to vary or adjust the tension.

Yet another object of the present invention is to provide a net tensioning mechanism that requires a minimal amount of rigging, and which is readily adaptable to net designs having four or more sidewalls.

BRIEF SUMMARY OF THE INVENTION

In accordance with a broad aspect of the present invention, there is provided an apparatus for supporting and tensioning a net, the net having a relatively large open end for receiving a ball or similar object projected therein, a relatively small back wall, and enclosing side walls extending from the open end to the back wall. Although four side walls are preferred (viz. a bottom side wall, a top side wall, a left side wall and a right side wall), there is no imperative that the number of side walls be limited to four.

The supporting framework includes a forward support frame, means for coupling the perimeter of the open end of the net with the forward support frame to hold the open end in a wide open condition, a rear support frame, and frame stabilizing numbers for holding the forward support frame and the rear support frame in a spaced upright condition.

The net tensioning mechanism comprises a hub disposed between the back wall and the rear support frame, the hub supporting a plurality of angularly spaced retainers each of which are supported by a hub equidistant and radially away from the hub axis. Coupling means (for example, rigging cord) is provided to couple the perimeter of the back wall of the net with the retainers, and a pulling means is provided for adjustably drawing the hub along its axis rearwardly towards the rear support frame.

In a preferred embodiment of the present invention, the pulling means comprises a rod that extends longitudinally along the hub axis, the hub being connected to one end of the rod. By pulling the rod rearwardly along the hub axis, a desired degree of tension may be applied to the net.

As will become apparent, a net having four side walls requires only four retainers. The amount of associated rigging is minimal (viz. that required each of the four corners of the net's back wall to one of the four retainers).

The invention will now be described in more detail with reference to the accompanying drawings.

BRIEF DESCRIPTION OF THE DRAWINGS

FIG. 3 is an end elevation view of the structure shown in

FIG. 2 (shading depicting the walls of the net having been deleted for clarity of illustration).

DETAILED DESCRIPTION

Figure 1:
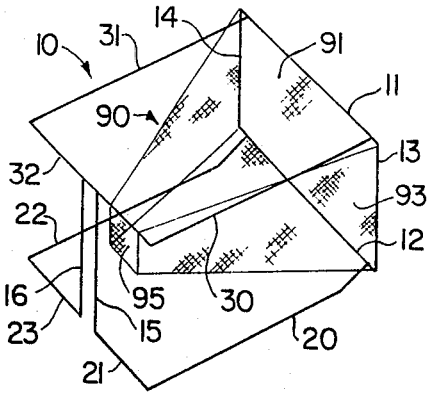
FIG. 1 is a perspective view of a net supporting frame in accordance with the present invention.

The net supporting framework shown in FIGS. 1 to 4 and generally designated 10 is designed to provide support for a net generally designated 90. As illustrated, net 90 includes four side walls 91, 92, 93, 94, all converging from an open front end 96 to a back wall 95. Note in FIG. 3 that the shading used in FIGS. 1, 2 and 4 to depict the appearance of a net has been deleted. However, lines 97, representing cord where the side walls and back wall of net 90 are sewn or stitched together or joined by other suitable means, remain.

Figure 8:
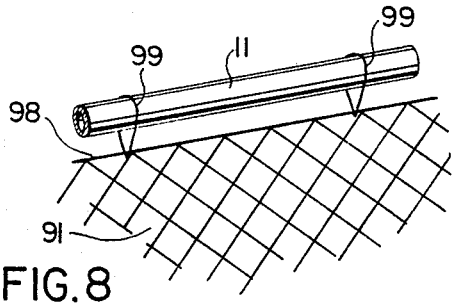
FIG. 8 illustrates rigging used to couple a net to the supporting frame shown in FIG. 1.

Framework 10 is preferably fabricated from metal tubing and, as is discussed below with reference to FIG. 9, may have a knock-down structure for ease of storage. This framework includes a rectangular forward support frame formed by horizontal members or tubes 11, 12 joined by vertical members or tubes 13, 14. As best shown in FIG. 8 which, by way of example, shows a portion of the length of tube 11, the perimeter 98 of the open end of net 90 may be coupled to the forward support frame by means of small cords or straps 99 located at spaced intervals along the perimeter. This will hold open end 96 of net 90 in a wide open condition.

Framework 10 also includes a rear support frame formed by a pair of narrowly spaced vertical members or tubes 15, 16. The rear support frame and the forward support frame are joined and stabilized in a spaced upright condition by stabilizing members or tubes 20, 21, 22, 23 forming the base of the framework, and stabilizing members or tubes 30, 31, 32 forming the top of the framework (tube 32 extending across the top from tube 30 to tube 31).

Figure 2:
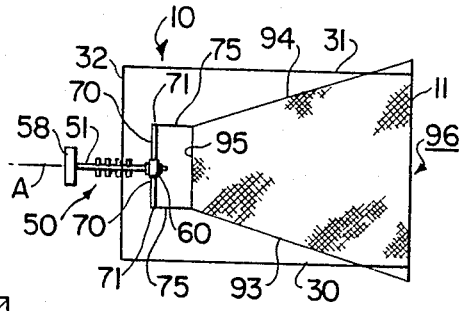
FIG. 2 is a top view of the frame shown in FIG. 1 with the added provision of a net tensioning mechanism in accordance with the present invention.
Figure 3:
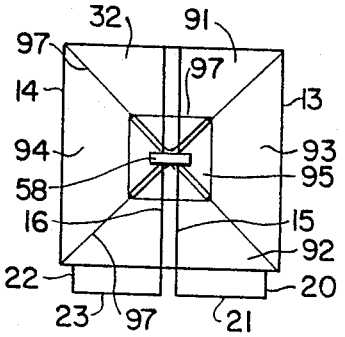
Figure 4:
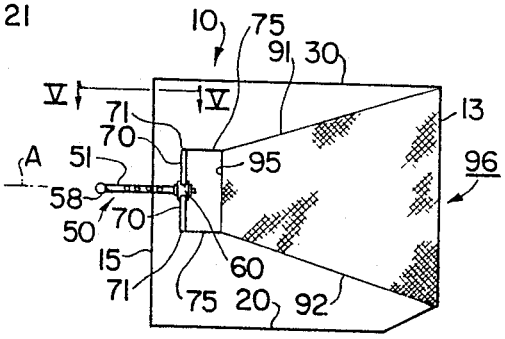
FIG. 4 is a side elevation view of the structure shown in FIG. 2.

To assist with clarity of illustration, FIG. 1 does not show any means holding net 90 in the tensioned condition indicated. However, such means are shown in FIGS. 2 to 4 in the form of a net tensioning mechanism generally designated 50, details of which are more clearly illustrated in FIGS. 5 to 7.

Net tensioning mechanism 50 includes a hub 60 rotatably mounted at one end 52 of a rod 51, the latter of which extends from behind framework 10 and forwardly through the relatively narrow space between rear support tubes 15, 16. End 52 is threaded and has a somewhat narrower diameter than the remaining length of rod 51. As such, it fits slidingly through axial hole 61 (see FIG. 7) in hub 60. When hub 60 is mounted to end 52, a washer 62 is first placed in position over the end; followed by the hub; then a lockwasher 65; and finally a wind nut 66 which threadingly engages the end. The hub is thus secured lengthwise on rod 51, but the rod is rotatable with respect to the hub about hub axis "A".

Net tensioning mechanism 50 further includes angularly spaced retainers in the form of four retainer arms 70 spaced at 90° intervals around hub 60. Each arm extends equidistant are radially away from the hub to an outer end 71, and each outer end is coupled to the perimeter of back wall 95 of net 90. More specifically, each outer end 71 is coupled by means of a flexible cord 75 tied between the end and a corresponding corner on the perimeter of back wall 95.

Figure 5:
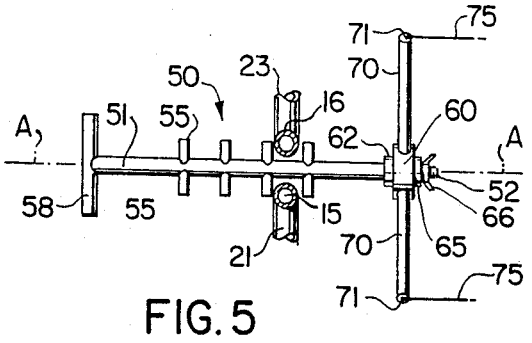
FIG. 5 is a top view showing in more detail the net tensioning mechanism illustrated in FIG. 2.

As best seen in FIG. 5, eight legs 55 arranged in pairs extend transversely from rod 51 at spaced intervals, the spacing being greater than the diameter of rear support tubes 15, 16. The legs in each pair extend in line from opposite sides of rod 51 and have a combined length greater than the space between tubes 15, 16. Thus, when rod 51 has the orientation shown in FIG. 5, horizontal movement of net tensioning mechanism 50 is impeded. Movement is blocked by engagement between tubes 15, 16 and one of the pairs of legs 55.

Figure 6:
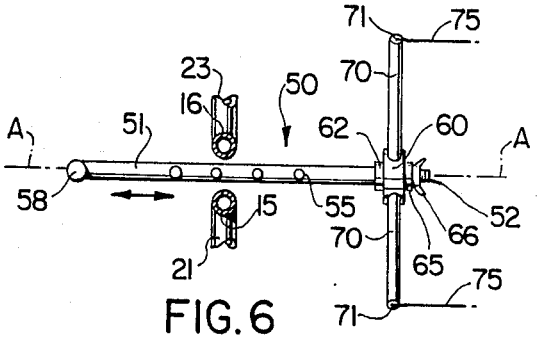
FIG. 6 is a top view of the net tensioning mechanism of FIG. 5 when rotated through an angle of 90°.
Figure 7:
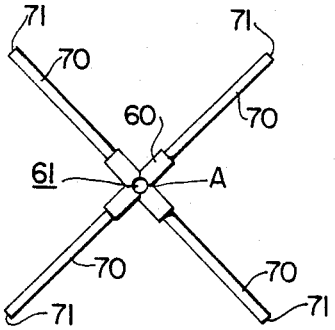
FIG. 7 is a front elevation view of the hub and retaining arms of the tensioning mechanism shown in FIG. 2.

However, when rod 51 is rotated 90° from the position shown in FIG. 5 to the vertical position shown in FIG. 6, then such horizontal movement of net tensioning mechanism 50 is not blocked. As can be seen in FIG. 6, legs 55 are passable through the space between tubes 15, 16 in their vertical orientation. Thus, horizontal motion of mechanism 50 is permitted along hub axis "A" as indicated by double arrow "M" in FIG. 6.

It will be readily appreciated that rod 51 and its legs 55 provide a means for adjustably drawing hub 60 along axis "a" rearwardly towards the rear support frame formed by tubes 15, 16. Indeed, the entire tensioning mechanism 50 will move rearwardly and, by reason of its coupling with back wall 95 of net 90, necessarily pulls the back wall rearwardly. More or less tension is thereby applied to side walls 91, 92, 93, 94 depending on the horizontal position of hub 60. Handle 58 on rod 51 provides a manual grip to better facilitate pulling net tensioning mechanism 50 along axis "a", and to better facilitate rotating rod 51 about such axis.

From the figures, it will be appreciated that the four pairs of legs 55 admit to four positions of tensioning adjustment. In the position shown in FIGS. 2, 4 and 5, there is a relatively high degree of tension, but the tension may be increased by one step (viz. by pulling tensioning mechanism 50 to the left). Conversely, the tension may be reduced by two steps, by releasing the engagement shown in FIG. 5 and permitting the resilience of the net to slacken and to draw tensioning mechanism 50 to the right.

While it would be possible to provide a net tensioning mechanism that admitted to finer adjustment of tension (for example, a continuous screw adjustment having threaded engagement with the rear support frame), a mechanism of the type illustrated in the drawings is preferred. It enables fast adjustments to be made, and is uncomplicated and durable in structure. Further, it is doubtful that provision for a higher degree of resolution in tension adjustment would make any material difference to a person using the net.

Figure 9:
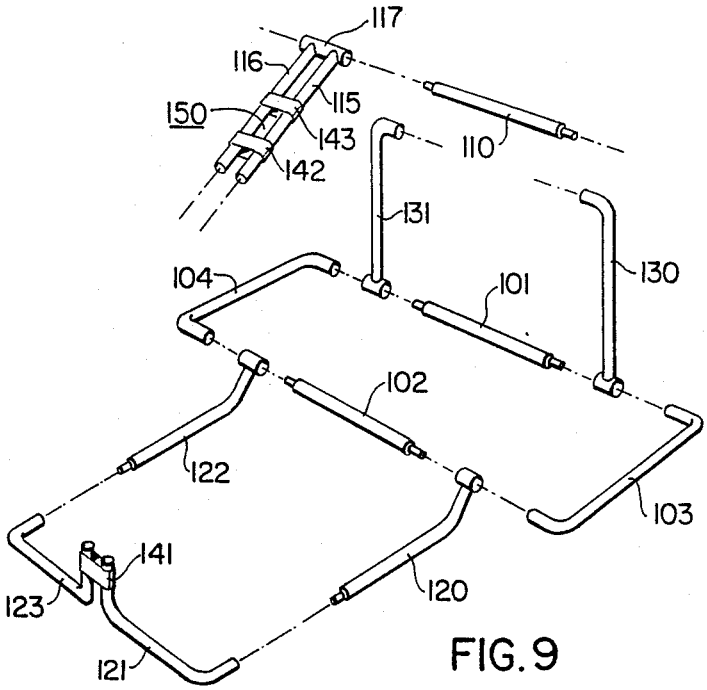
FIG. 9 is an exploded and rotated perspective view showing in more detail an assembly structure for a net supporting frame as shown in FIG. 1.

Referring now to FIG. 9, it can be seen that a net supporting framework of the type shown in FIGS. 1 to 4 can have a knock-down structure readily fabricated from several tubing segments and joining sleeves. In FIG. 9, segments 101, 102, 103, 104 together provide a forward support frame. (Note that for purposes of illustration only, this frame has been exploded and rotated forwardly to a horizontal position). Segments 115, 116 coupling at the top of segment 110 by sleeve 117, and at the bottom with base segments 121, 123 provided a rear support frame, the stability of which is enhanced by bands 141, 142 and 143. (Segments 115, 116 normally rise vertically from the back to the structure, but are shown angled and exploded away from the back for the purpose of illustration.) The forward and rear support frames are coupled at the top by segments 130, 131 and at the bottom by segments 120, 122.

As noted above, bands 141, 142 and 143 serve to enhance stability. However, bands 142, 143 are primarily designed to interact with a net tensioning mechanism of the type discussed above. More specifically, a rod (such as rod 51) of the net tensioning mechanism will be extended through the space 150 between bands 142, 143, a handle (such as handle 58) of the rod having a length greater than the distance between the bands. Bands 142, 143 will thereby limit slackening of a net to the point where the handle moves up against the bands. Depending on the length of the rod, this may be a very slack tension (or no tension) such that there is insufficient tension to hold the net tension mechanism in its vertical position against the rear support frame. In this case, the mechanism will drop to rest on bank 142 but remain substantially in position.

Figure 10:
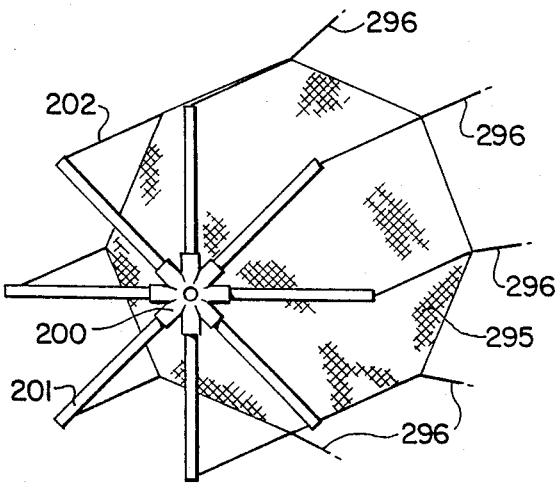
FIG. 10 illustrates the hub and retaining arms of a tensioning mechanism in accordance with the present invention for use with an eight-sided net.

FIG. 10 illustrates that a net tensioning mechanism in accordance with the present invention is not limited to a net with four walls. This figure shows a hub 200 and eight retainer arms 201 coupled by eight cords 202 to the perimeter of a back wall 295 of an eight-sided net, the partial edges between some of such sides being indicated by lines 296. While it is contemplated that the forward support frame (not shown) for an eight-sided net would have a corresponding eight-sided configuration, it will be readily appreciated that the remaining structure of a support frame and net tension mechanism amy proceed along lines basically the same as that described for a four-sided net.

Obviously, just as the number of sides is not limited to four, it is not limited to eight. The present invention is readily adaptable to a varying number of sides. Indeed, it is contemplated that the present invention may readily be adapted for a net having the configuration of a truncated cone with a circular back wall.

Various modifications to the present invention within the scope of the following claims are possible and will undoubtedly occur to those skilled in the art.

I claim:

1. Apparatus for supporting and tensioning a net, said net having a relatively large open end for receiving a ball or similar object projected therein, a relatively small back wall, and enclosing side walls extending from said open end to said back wall, said apparatus comprising: (a) a supporting framework, including:

(i) a forward support frame;

(ii) means for coupling the perimeter of the open end of said net with said forward support frame to hold said open end in a wide open condition;

(iii) a rear support frame; and, (iv) frame stabilizing members for holding said forward support frame and said rear support frame in a spaced upright condition;

and, (b) a net tensioning mechanism, comprising:

(i) a hub having a central axis, said hub being disposed between said back wall and said rear support frame;

(ii) a plurality of angularly spaced retainers supported by said hub equidistant and radially away from said axis;

(iii) means for coupling the perimeter of said back wall with said retainers; and (iv) pulling means for ajustably drawing said hub along said axis rearwardly towards said rear support frame.

2. Apparatus as defined in claim 1, wherein said rear support frame comprises a pair of narrowly spaced vertically extending frame members.

3. Apparatus as defined in claim 2, wherein said pulling means comprises:

(a) a rod extending longitudinally along said hub axis through the space between said vertically extending frame members;

(b) coupling means for rotatable connecting one end of said rod with said hub; and, (c) a plurality of legs arranged in pairs and extending transversely from said rod at spaced intervals therealong; the legs of each such pair extending in line from opposite sides of said rod so as to be passable through the space between said vertically extending frame members when vertically oriented, and having a combined length greater than the space between said vertically extending frame members so as to engage said frame members when horizontally oriented.

4. Apparatus as defined in claim 3, the length of said rod and the distance between successive pairs of said legs permitting tensioning of said net between a relatively slack tension and a relatively high tension.

5. Apparatus for supporting and tensioning a net, said net having a relatively large rectangular open end for receiving a ball or similar object projected therein, a relatively small rectangular back wall, and enclosing upper, lower, left and right side walls extending from said open end to said back wall, said apparatus comprising:

(a) a supporting framework, including:

(i) a forward support frame;

(ii) means for coupling the perimeter of the open end of said net with said forward support frame to hold said open end in a wide open condition;

(iii) a rear support frame; and, (iv) frame stabilizing members for holding said forward support frame and said rear support frame in a spaced upright condition; and, (b) a net tensioning mechanism, comprising:

(i) a hub having a central axis, said hub being disposed between said back wall and said rear support frame;

(ii) four retainer arms angularly spaced at 90° intervals around said hub and extending equidistant and radially from said hub to outer ends;

(iii) means for coupling the outer end of each of said retainer arms with a corresponding corner of the back wall of said net; and, (iv) pulling means for adjustably drawing said hub along said axis rearward towards said rear support frame.

6. Apparatus as defined in claim 5, wherein said rear support frame comprises a pair of narrowly spaced vertically extending frame members.

7. Apparatus as defined in claim 6, wherein said pulling means comprises:

(a) a rod extending longitudinally along said hub axis through the space between said vertically extending frame members;

(b) coupling means for rotatably connecting one end of said rod with said hub; and, (c) a plurality of legs arranged in pairs and extending transversely from said rod at spaced intervals therealong; the legs of each such pair extending in line from opposite sides of said rod so as to be passable through the space between said vertically extending frame members when vertically oriented, and having a combined length greater than the space between said vertically extending frame members so as to engage said frame members when horizontally oriented.

8. Apparatus as defined in claim 7, the length of said rod and the distance between successive pairs of said legs permitting tensioning of said net between a relatively slack tension and a relatively high tension.

* * * * *